US005743320A

United States Patent [19]

McKeon

[11] Patent Number: 5,743,320

[45] Date of Patent: Apr. 28, 1998

[54] OBSTRUCTION-RESPONSIVE BRAKE ACTUATOR FOR FIRE DOOR OR THE LIKE

[75] Inventor: James M. McKeon, Brooklyn, N.Y.

[73] Assignee: Mckeon Rolling Steel Door Company, Inc., Brooklyn, N.Y.

[21] Appl. No.: 664,205

[22] Filed: Jun. 11, 1996

Related U.S. Application Data

[60] Provisional application No. 60/009,429, Dec. 29, 1995.

[51] Int. Cl. [6] ..... E06B 9/56

[52] U.S. Cl. ..... 160/310; 160/8; 160/291; 49/27

[58] Field of Search ..... 160/188, 310, 160/1, 7, 8, 133, 291, 3, 4; 49/26, 27

[56] References Cited

U.S. PATENT DOCUMENTS

| | | | |
|---|---|---|---|
| 1,001,990 | 8/1911 | Rowntree | 49/27 |
| 2,687,455 | 8/1954 | Norman | 200/61.43 |
| 3,627,082 | 12/1971 | Berkovitz et al. | 187/52 |
| 4,034,275 | 7/1977 | Mangel | 318/461 |
| 4,115,952 | 9/1978 | French | 49/26 |
| 4,262,176 | 4/1981 | Kapitza et al. | 200/61.43 |
| 4,794,973 | 1/1989 | Perisic | 160/8 X |
| 5,191,268 | 3/1993 | Duhame | 318/266 |
| 5,197,582 | 3/1993 | Cropley | 192/1.37 |
| 5,203,392 | 4/1993 | Shea | 160/310 X |
| 5,228,492 | 7/1993 | Jou | 160/188 |
| 5,245,879 | 9/1993 | McKeon | 160/188 X |
| 5,386,891 | 2/1995 | Shea | 160/7 X |

*Primary Examiner*—Blair Johnson

*Attorney, Agent, or Firm*—Cohen, Pontani, Lieberman, Pavane

[57] ABSTRACT

A brake actuator for use in conjunction with a door barrier for preventing closure of the door barrier when the actuator comes in contact with an obstruction. The brake actuator includes a bumper mounted on a leading edge of the barrier and movable between an operative position and an inoperative position. A load carrying linkage is provided which is activated when the bumper is moved to the operative position. The linkage is connected to a brake which becomes engaged when the linkage is activated, thus preventing movement of the door barrier to a closed position when the bumper contacts the obstruction.

10 Claims, 6 Drawing Sheets

OBSTRUCTION-RESPONSIVE BRAKE ACTUATOR FOR FIRE DOOR OR THE LIKE

RELATED APPLICATIONS

This application claims priority from provisional application Ser. No. 60/009,429 filed on Dec. 29, 1995.

FIELD OF THE INVENTION

The present invention relates to an obstruction-responsive brake actuator and, more particularly, to an obstruction-responsive brake actuator for a safety barrier, such as a fir door, which prevents further closure of the safety barrier when an obstruction is encountered.

BACKGROUND OF THE INVENTION

Safety barriers, such as fire doors, for buildings and the like automatically close in response to certain emergencies, such as a fire. Safety barriers which automatically close by falling downwardly under the force of gravity may close with considerable force because of the substantial weight of the barrier. Safety barriers which close by sideways or upward displacement may also close with considerate force owing to the powerful spring mechanisms employed to close such safety barriers. Objects struck by such safety barriers during automatic closure thereof may be severely damaged and, in the case of persons, severely injured.

Because of this potential hazard, safety edge devices often include one or more sensors, such as a switch, for generating an electrical signal upon contact with an obstruction. The sensors are electrically connected to a motor which controls movement of the door such that when a sensor engages an object upon closure of the door, the motor stops movement of the door toward its closed position and, in some cases, reverses the direction of movement of the door.

A problem with such safety edge devices arises when they are used with safety barriers which automatically close in response to certain emergencies. Some such emergencies, such as fires, are accompanied by electrical power failures. Because known safety edge devices require electricity for operation, such devices may be inoperable during the very emergencies when they may do the most good.

SUMMARY OF THE INVENTION

According to one aspect of the present invention, an obstruction-responsive brake actuator is used with a safety barrier of the type including a curtain having a leading edge. A brake is operatively engageable with the curtain for preventing closure thereof, the brake being biased against operative engagement with the curtain. The curtain is of the type which, when not in operative engagement with the brake, is biased to close.

The obstruction-responsive brake actuator comprises a support and a bumper carried by the support and movable to and from an operative position relative thereto. The brake actuator also includes a continuous load-carrying linkage carried by the support in abutting relation to the bumper. The linkage includes an actuator movable into and out of an actuating position relative to the support. The linkage has sufficient load-carrying capacity such that when a force is applied to the bumper sufficient for movement thereof to its operative position, the force is transmitted through the linkage to the actuator for movement thereof to the actuating position. Movement of the bumper out of its operative position reduces the force applied by the linkage to the actuator sufficiently to allow movement thereof out of its actuating position.

The support is securable to the leading edge of the curtain and engages the bumper. The actuator is coupled to the brake such that movement of the actuator to its actuating position operatively engages the brake with the curtain. The actuator is movable to its actuating position when the bumper is urged against an obstructing object by a force greater than the force biasing the brake out of operative engagement with the curtain.

The various features of novelty which characterize the invention are pointed out with particularity in the claims annexed to and forming a part of this disclosure. For a better understanding of the invention, its operating advantages, and specific objects attained by its use, reference should be made to the following detailed description in conjunction with the accompanying drawings in which there are illustrated and described currently preferred embodiments of the invention. It is to be understood, however, that the detailed description and drawings are intended to illustrate and not to define the limits of the invention.

BRIEF DESCRIPTION OF THE DRAWINGS

In the drawings, wherein like reference characters denote similar elements throughout the several views.

DETAILED DESCRIPTION OF THE PREFERRED EMBODIMENTS

Figure 1:
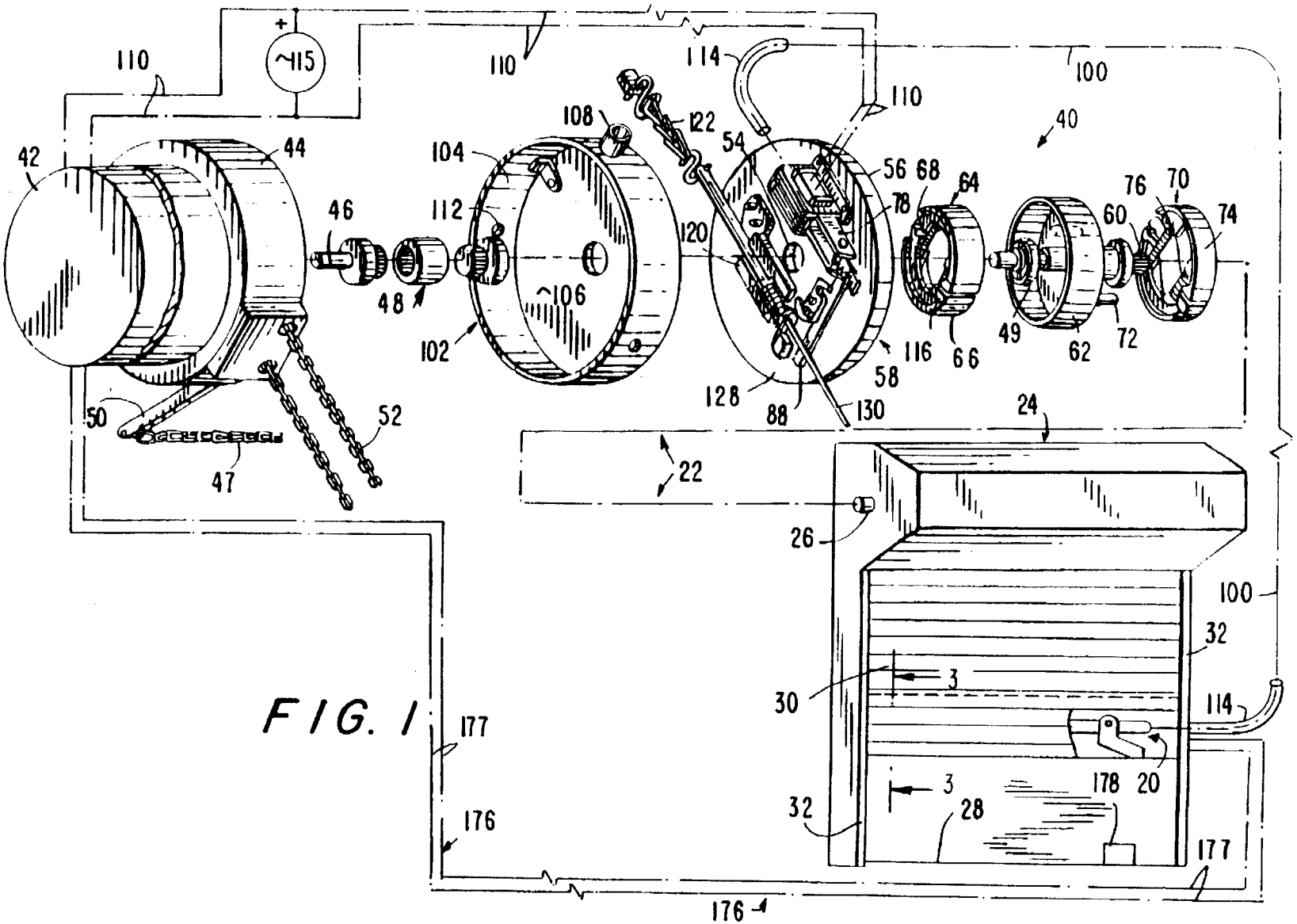
FIG. 1 is a partially exploded perspective view of an obstruction-responsive brake actuator of the present invention depending from the leading edge of a motor-controlled fire door assembly.

Referring now to the drawings, FIG. 1 illustrates a brake actuator and, more particularly, an obstruction-responsive brake actuator identified by the general reference number 20 and constructed in accordance with the teachings of the present invention. The motor controlled fire door assembly shown in FIG. 1 and generally designated by the reference number 22 is disclosed in U.S. Pat. No. 5,245,879, the entire disclosure of which is expressly incorporated by reference herein.

The motor-controlled fire door assembly 22 includes a frame 24 which horizontally supports a low speed output shaft 26 at an elevated position relative to ground 28, which is typically, though not necessarily, a structurally reinforced floor. A curtain 30 is wound around the output shaft 26 which is rotatable about its longitudinal axis for raising and lowering the curtain 30. Frame 24 includes vertical tracks 32 for engaging and guiding the side edges of curtain 30 during raising and lowering thereof. Curtain 30 has a leading edge 34 and, as will be described in detail hereinbelow, the brake actuator 20 is secured to the curtain 30 in depending relation to its leading edge 34.

Rotation of output shaft 26 is controlled by a motor-operator unit, such as the motor-operator unit disclosed in U.S. Pat. No. 5,245,879. Only that part of the motor operator unit considered pertinent to the present invention is disclosed in FIG. 1 and generally designated at 40.

Motor-Operator Unit

The motor-operator unit 40 includes a motor 42 secured to a conventional hand chain assembly 44. The motor 42 is coupled to rotatable drive shaft 46. Alternatively, the shaft 46 may be rotated by pulling a hand chain 52 when, for example, motor 42 is unavailable due to a power interruption. Hand chain 52 is operatively engaged with shaft 46 for effecting rotation thereof by a lever 50 which, in turn, is activated by pulling a lever cord 47.

The shaft 46 engages a coupling 48 which, in turn, drives a shaft 49 passing through a hole 54 in a support plate 56 of a brake controller 58. The other end of input shaft 49 is connected to a splined shaft 60 which, in a manner more fully described in U.S. Pat. No. 5,245,879, drives output shaft 26 for raising and lowering curtain 30.

The motor-operator unit 40 includes a cast iron drum 62 secured to shaft 49 for rotation therewith. A brake 64 secured to support plate 56 is disposed within the drum 62 and is independent of rotation thereof. The brake 64 includes a pair of pivotally connected brake shoes 66 for selectively engaging drum 62 for blocking rotation of input shaft 49 and output shaft 26 coupled thereto. A pair of tension springs 68 bias the brake shoes 66 out of engagement with drum 62, the bias of the tension springs being overcome when the brake is actuated, as will be more fully explained below.

The motor-operator unit 40 further includes a speed governor 70 connected by a pin 72 to drum 62 for rotation therewith. Governor 70 includes a pair of pivotally connected brake shoes 74 and a pair of tension springs 76 which bias brake shoes 74 out of engagement with a stationary housing (not shown) until shaft 49 rotates above a predetermined speed whereupon centrifugal forces separate brake shoes 74 for applying a braking friction against the inside of the stationary housing to slow the rotational speed of shaft 49 and output shaft 26 coupled thereto. For example, automatic closure of curtain 30 may result in shaft 49 reaching an unacceptably high rotational speed thereby actuating governor 70 for preventing the curtain from slamming shut at an undesirably high speed.

Figure 2A:
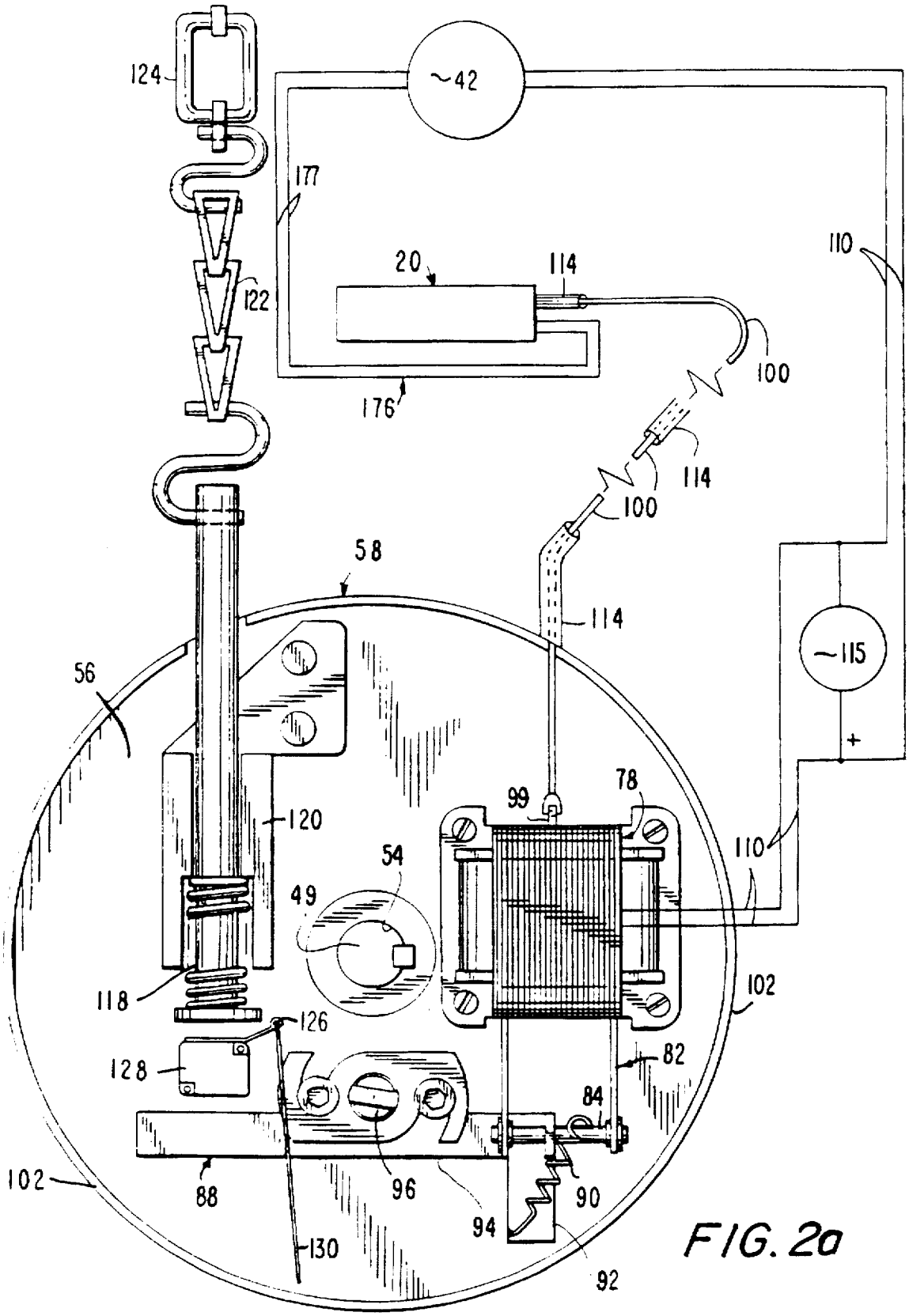
FIGS. 2*a* and 2*b* are elevational views, partly in schematic, of the brake controller and actuator of FIG. 1 showing the relative positions of parts when the brake is released (FIG. 2*a*) and when the brake engages the curtain to prevent closure thereof (FIG. 2*b*)
Figure 2B:
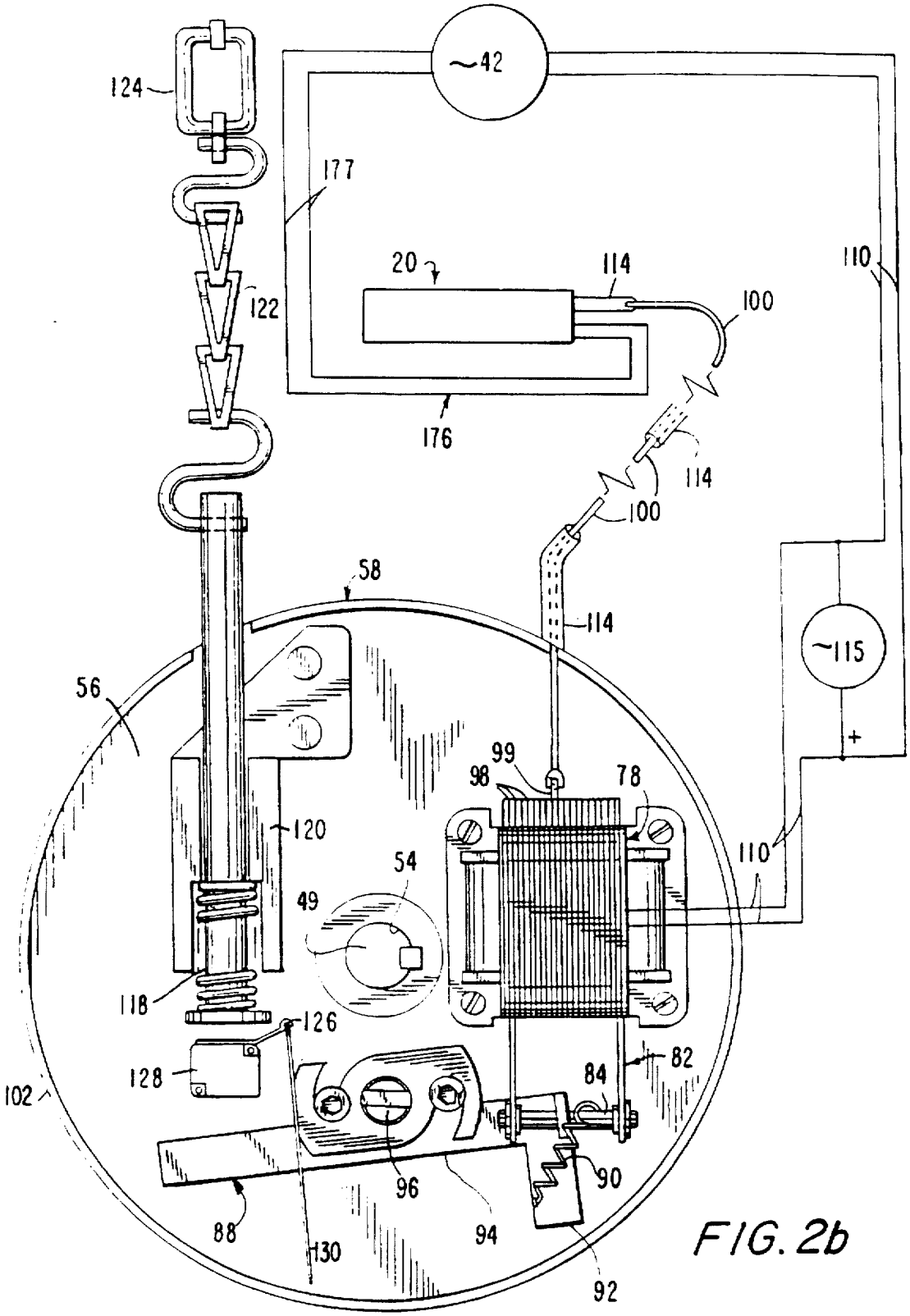

As illustrated in FIGS. 1, 2*a* and 2*b*, brake controller 58 includes a brake solenoid 78 mounted on support plate 56 and having a core 82 terminated with a cross pin 84. A take-up spring 90 is hooked at one end to cross pin 84 and at the other end to an upstanding flange 92 on brake control lever 88 such that the spring 90 couples the cross pin and brake control lever. The intermediate portion 94 of brake control lever 88 is fixed to a rotatable brake control shaft 96 for rotation therewith.

The core 82 of brake solenoid 78 includes a plurality of laminates 98, one of which 99 extends beyond the others as shown in FIGS. 2*a* and 2*b*. Secured to laminate extension 99 is a brake cable 100 which, in turn, is connected to brake actuator 20 as described further hereinbelow.

Referring to FIG. 1, the motor-operator unit 40 also includes a sheet metal cylindrical housing 102 having an intermediate circular plate 106 defining a chamber on either side thereof, one of which 104 is shown in FIG. 1. The support plate 56 and the components of brake controller 58 mounted thereon are received in one chamber (not shown). The other chamber 104 receives the coupling 48 when the housing 102 is secured to the housing of the hand chain assembly 44.

Mounted on the side wall of housing 102 is a boss 108 having a longitudinal passage therethrough for connecting electrical conductors 110 to brake solenoid 78. The side wall of housing 102 also includes an opening (not shown) through which brake cable 100 extends.

The brake cable 100 extends between laminate extension 99 and brake actuator 20 through a sleeve 114 shown schematically in FIGS. 1, 2*a* and 2*b*. One end of the sleeve abuts housing 102 and an opposite end is fixed to the brake actuator, as further described hereinbelow. Brake cable 100 is preferably steel or other metal, and sleeve 114 is preferably plastic, such as PVC, although other materials may be used provided they are transversely flexible but longitudinally-stiff such that longitudinal translation of one end of the brake cable relative to sleeve 114 produces concomitant translation at the opposite end thereof.

The brake solenoid 78 is electrically connected, via conductors 110, to electrical source 115. Referring to FIG. 2*b*, when electrical source 115 supplies power to brake solenoid 78, core 82 is retracted. Because core 82 is secured via cross pin 84 and spring 90 to lever 88, retraction of core 82 effects counterclockwise rotation of lever 88 and of brake control shaft 96 secured thereto. The brake control shaft 96 extends through a hole (not shown) in support plate 56 and into a cavity 116 in brake 64. The free end of brake control shaft 96 interlocks with the walls of cavity 116 in a key-type engagement such that counterclockwise rotation of the brake control shaft 96 causes brake shoes 66 to pivot outwardly into engagement with drum 62 for blocking rotation of output shaft 26 thereby blocking closure of curtain 30.

In a known manner, the take-up spring 90 compensates for wear of brake shoes 66 by allowing brake control lever 88 to be set relative to brake control shaft 96 to outwardly pivot the brake shoes, even when in a worn condition, sufficiently to produce engagement thereof with drum 62. This setting may also be used when brake shoes 66 are new, and normally thicker, since take-up spring 90, by deflecting, limits the force exerted on the brake shoes by movement of brake solenoid 78.

The tension springs 68 connected between brake shoes 66 resist the outward pivoting thereof attendant engagement of the brake shoes with drum 62. Thus, when a force exerted on brake shoes 66 causing engagement thereof with drum 62 is removed, the brake shoes are pivoted inwardly to a position in which the brake shoes are disengaged from the drum.

Brake controller 58 also includes a spring-loaded plunger 118 slidably mounted in a bracket 120 attached to support plate 56. The plunger 118 is held in a retracted position by a chain 122 located externally to motor-operator unit 40. The chain 122 includes a fusible link 124 with a melting temperature of about 135 degrees Fahrenheit. When fusible link 124 melts, the plunger 118 is driven by the spring-loading thereof into engagement with an emergency actuator 126 for depressing the latter. Depression of emergency actuator 126 opens an emergency switch 128 which interrupts power to brake solenoid 78 thereby releasing the brake 64 and allowing curtain 30 to close. The emergency switch 128 may also be opened for releasing brake 64 by pulling a hand cable 130 connected thereto. When brake controller 58 is disposed in housing 102, plunger 118 and hand cable 130 extend through respective openings in the side wall of housing 102.

Brake Actuator

Figure 3:
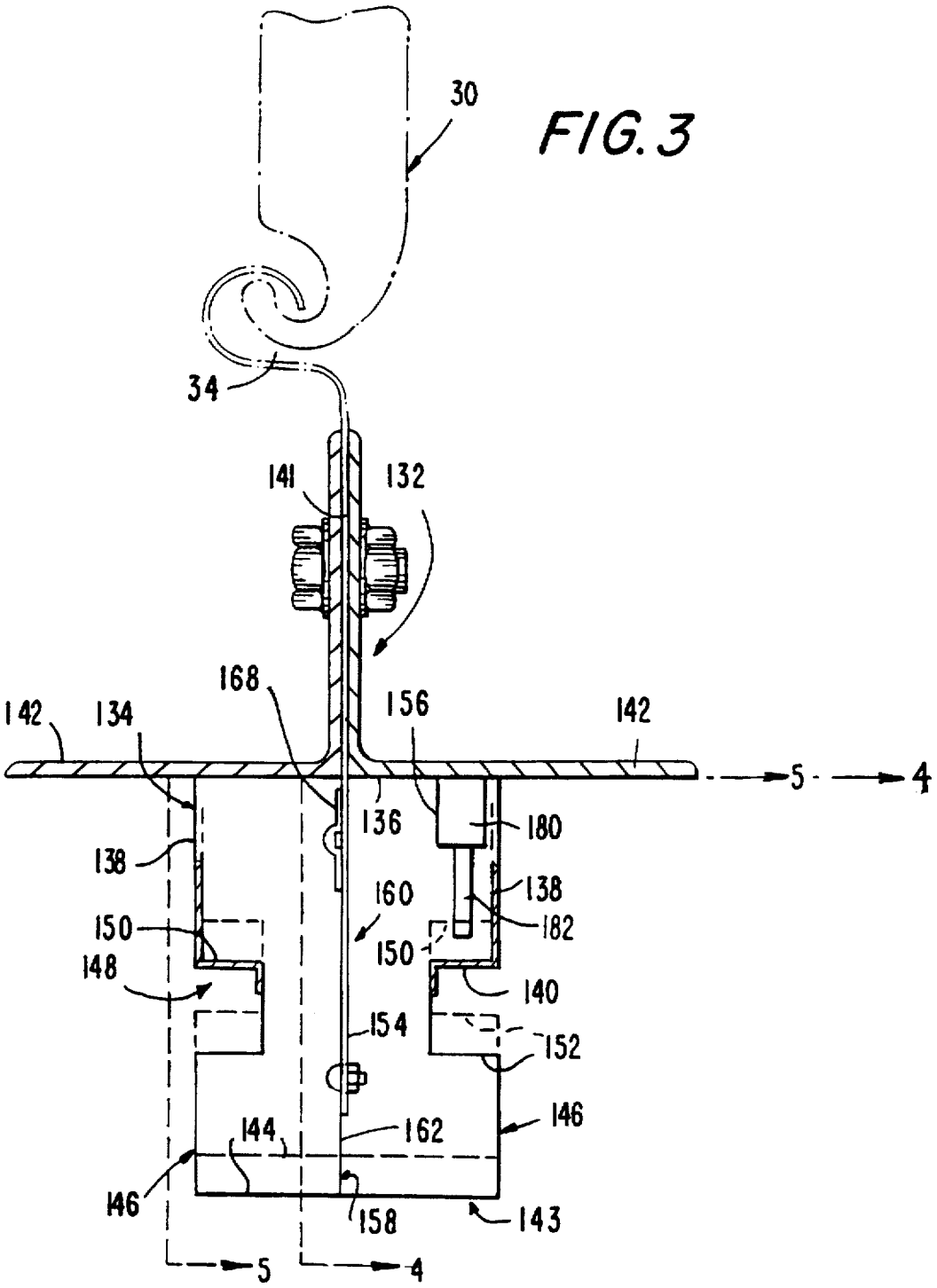
FIG. 3 is a cross sectional view of the obstruction-responsive brake actuator taken along line 3—3 in FIG. 1 showing the bumper in its operative position (dashed lines) and out of its operative position (solid lines)
Figure 4:
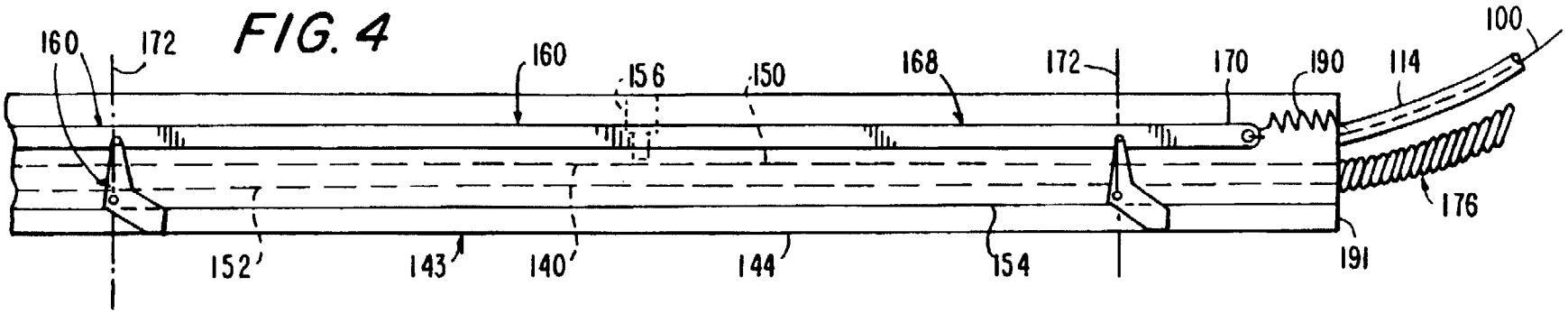
FIG. 4 is a cross sectional view of a portion of the obstruction-responsive brake actuator taken along line 4—4 of FIG. 3 and showing the load-carrying linkage.
Figure 5:
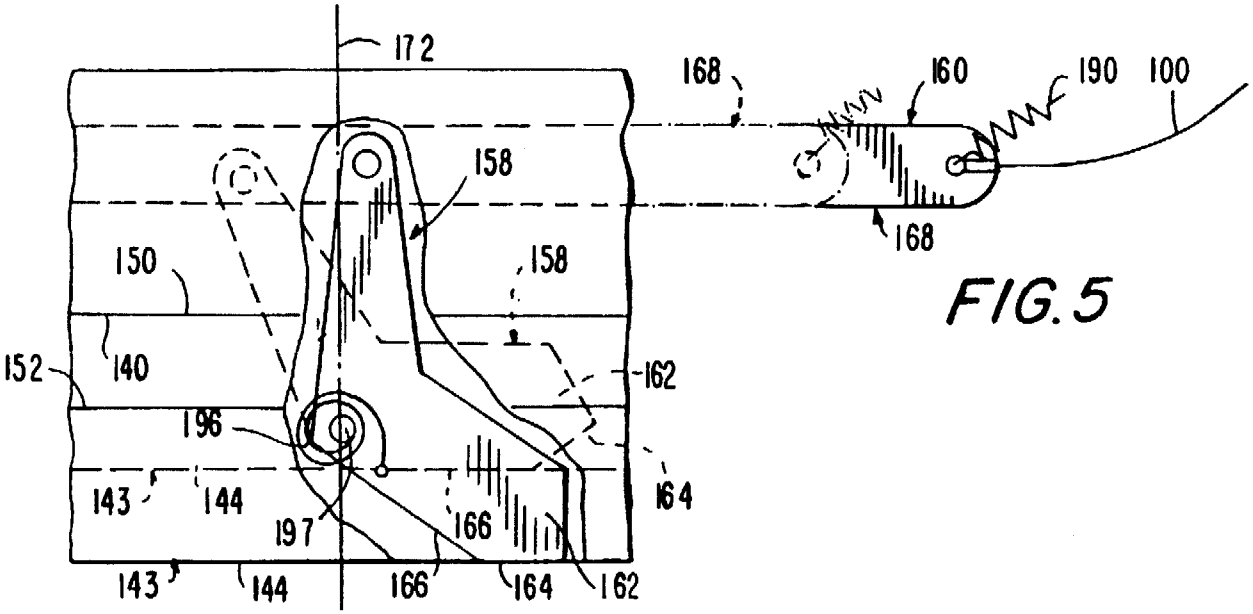
FIG. 5 is a fragmentary view of a portion of the obstruction-responsive brake actuator taken along line 5—5 of FIG. 3 showing the arm and one of the linkage levers in the operative position (dashed lines) and out of the operative position (solid lines)

The obstruction-responsive brake actuator 20, shown generally in FIG. 1 and in detail in FIGS. 3, 4 and 5, comprises a support 132 including an elongate shelf member 134 preferably formed of extruded aluminum. As shown in FIG. 3, shelf member 134 has a top wall 136 and a pair of opposed depending side wells 138, the end of each side wall having an inturned lip 140.

The support 132 further includes a structure for securing shelf member 134, preferably in a releasable fashion, to leading edge 34 of curtain 30. Those skilled in the art will appreciate that numerous structures within the scope of the invention will serve this purpose. One such structure, shown in FIG. 3, includes a hanger slat 141 attached to top wall 136. The upper edge of hanger slat 141 is hook-shaped for hanging from the lip-shaped leading edge 34 of curtain 30 in a known manner as depicted in FIG. 3. The interlocking engagement between the hook-shaped upper edge of hanger slat 141 and leading edge 34 facilitates mounting and removal of brake actuator 20 on curtain 30.

It will be appreciated that hanger slat 141 may extend along the entire length of top wall 136 or only along discrete portions thereof. Similarly, the upper edge of hanger slat 141 may be hooked, as shown in FIG. 3, along its entire length or only along discrete portions thereof. All such embodiments are within the scope of the present invention. Preferably, shelf member 134 has a length which is substantially the same as that of leading edge 34 of curtain 30. It will be understood, however, that the invention contemplates embodiments in which the length of shelf member 34 is less than that of the leading edge 34.

As best seen in FIG. 3, and as is conventional, a pair of steel angles 142 are bolted to opposite sides of hanger slat 141 in abutting relation to the upper surface of top wall 136. As with slat 141, it will be appreciated that angles 142 may extend along the entire length of top wall 136 or only along discrete portions thereof. Those skilled in the art will appreciate that hanger slat 141 and extensions 142 are conventionally found on the bottom of fire door except, of course, that in the conventional arrangement hanger slat 141 is not integral with shelf member 134 is proposed herein.

Still referring to FIG. 3, brake actuator 20 further includes a bumper generally designated at 143 and preferably formed is an aluminum extrusion. Bumper 143 has a bottom wall 144 and a pair of opposing upstanding side flanges 146. Confronting upper portions of side flanges 146 are inwardly recessed as indicated at 148, each recessed portion 148 being defined, in part, by upper and lower walls 150, 152.

The length of upper walls 150 preferably slightly exceeds the length of the lips 140 such that when bumper 143 is amounted on shelf member 134, substantially the entire length of upper walls 150 seats on the lips 140. It will be apparent that bumper 143 may be mounted on shelf member 134 by sliding one extrusion into the other so that upper wall 150 rests on lip 140, as shown in FIG. 3 and that when the bumper 143 is so mounted, the recesses 148 accommodate vertical displacement of bumper 143 relative to the shelf member 134.

End caps 191, which may be made of metal, plastic or any other suitable material, are preferably secured to the ends of shelf member 134 after bumper 143 is mounted thereon to block movement of the bumper relative to the shelf member. As the construction of such end caps and their securement to the shelf member 134 will be readily apparent to those of ordinary skill in the art who have read this description, a further description thereof is deemed unnecessary.

The support 132 further includes an elongate central flange 154 depending from top wall 136 between and parallel to side walls 138. The central flange 154 is rigidly fixed to top wall 136 as, for example, by welding, high-strength adhesive or the like, and may be formed of the same or a different material than shelf member 134. Most importantly, shelf member 134 and central flange 154 are extruded as an integral, unitary part.

While central flange 154 may, as shown in FIG. 3, bisect the channel defined by shelf member 134, this is not necessary and central flange 154 may be offset such that it is closer to one side wall 138 than the other. This may be desirable if one or more microswitches 156, described hereinbelow, are disposed on one side of central flange 154, in which event offsetting central flange 154 facilitates access to the microswitches for adjustment, repair or replacement.

The length of central flange 154 is preferably the same as that of shelf member 134. Central flange 154 may have cutouts or discontinuities therein which may advantageously reduce the weight thereof. Also, if the cutouts or discontinuities are located adjacent to one or more microswitches 156, access thereto may be facilitated.

As best seen in FIG. 4–5, the brake actuator 20 further includes a continuous, uninterrupted load-carrying linkage designated generally by the reference number 160 and including one or more linkage levers 158 each of which is individually attached to central flange 154 by a pivotal connection such as, but not limited to, a pin 197, rivet, stud or bolt, for rotation in a common plane parallel to the central flange. Each linkage lever 158 has a dog-leg shape including a forward portion 162 having an outer edge 164 and an actuation edge 166.

Each outer edge 164 is preferably bevelled relative to its respective actuation edge 166 such that when bumper 143 is in its fully downward position relative to shelf member 134 and the linkage levers 158 are rotated clockwise (solid lines in FIG. 5), the outer edges 144 are flush with or, preferably, slightly spaced from bottom wall 144. With reference to FIG. 3, it will be apparent that when the bumper is in its fully downward position upper walls 150 of bumper 143 abut inturned lips 140 of shelf member 134. The angle between each outer edge 164 and its adjoining actuation edge 166 also results in bottom wall 144 of bumper 143 being flush with the actuation edges 166 when the bumper 143 is in its upward or operative position (dashed lines in FIG. 5) as more fully described below.

The linkage levers 153 are preferably equally spiced along central flange 154 with the linkage levers nearest to the ends of shelf member 134 being approximately equivalent from their respective ends. The distance between adjacent linkage levers 153 is preferably approximately 24 to 30 inches although other distances as well as unequal spacings are within the scope of the invention.

The load-carrying linkage 160 includes an elongate substantially flat rigid arm 168. Brake cable 100 extending from brake controller 58 is secured to one end 170 of arm 168, though it will be appreciated hereinafter that brake cable 100 may be attached to another portion of arm 168. As depicted in FIG. 4 and as noted above, one end of sleeve 114 for brake cable 100 is secured to an end cap at one end of shelf member 134 and cable 100 extends through a hole in the end cap for attachment to arm 168. A spring 190 secured to the end cap 191 and to the arm 168 biases the arm to the right as seen in FIGS. 4 and 5. Other placements of spring 190 and other devices for biasing arm 168 to the right will be readily apparent to those who have read the description and all such placements and devices are within the contemplation of the present invention. For example, springs disposed between arm 168 and levers 158 which bias the levers 158 to their solid line positions in FIG. 5 and hence urge arm 168 to the right may be employed. In addition, and as is presently preferred, a spring 196 positioned on pin 197 and connected between pins 197 and lever 158 may be employed for biasing levers 158 to the solid line position of FIG. 5

Each linkage lever 158 is attached to arm 168 by a pivotal connection such as, but not limited to, a pin, rivet, stud or bolt. The pivotal connections between arm 168 and linkage levers 158 are at the end of the linkage levers opposite the forward portions 162.

Because each linkage lever 158 is pivotally secured to central flange 154 and to rigid arm 168, it will be apparent that displacement of bumper 143 toward shelf member 134 will cause each linkage 158 lever to rotate counterclockwise about its respective pivotal attachment to central flange 154 thereby displacing arm 168 leftwardly as viewed in FIGS. 4 and 5. Similarly, when arm 168 is displaced rightwardly as viewed in FIGS. 4 and 5 the linkage levers 158 are rotated clockwise about their respective pivotal attachments to central flange 154.

The length of brake cable 100 between arm 168 and laminate extension 99, shown generally in FIG. 1 and in greater detail in FIGS. 2*a* and 4, is such that the translation of the brake cable 100 to the position illustrated in FIG. 2*a* upon release of brake 64 is sufficient to pull the arm 160 to the right as is viewed in FIGS. 4 and 5 thereby rotating the linkage levers 158 clockwise about their respective pivotal attachments to central flange 154.

As depicted in FIGS. 3 and 4, the brake actuator 20 may include one or more springs (not shown) disposed between top wall 136 of shelf member 134 and upper walls 150 of recessed portions 148 for biasing bumper 143 to its fully downward position. The number of and placement of such springs for accompanying their stated objective is well within the capabilities of the person of ordinary skill in the art.

Microswitches

As shown in FIG. 3, the obstruction-responsive brake actuator 20 also includes one or more electrical switches, preferably microswitches 156, affixed to the bottom of top wall 136, the microswitches forming part of an electrical circuit as is explained hereinbelow. Preferably, microswitches 156 are equally spaced along the length of top wall 136 such that the distance between adjacent microswitches is approximately 24 to 30 inches. However, other distances as well as unequal spacings are within the scope of the invention. The microswitches 156 may be affixed to top wall 136 on either or both sides of central flange 154.

As is more fully explained below, each microswitch 156 is normally biased in an open switch condition and is movable to a closed switch condition when bumper 143 moves upwardly relative to shelf member 134 by a predetermined distance. Microswitches operating in this fashion are well known in the art. One such microswitch 156, shown schematically in FIG. 3, includes a housing 180 and a post 182 axially moveable relative to the housing through a hole (not shown) at the lower end thereof. The post 182 is biased outwardly from housing 180 by a spring (not shown) disposed in the housing and a stop on the end of post 182 inside housing 180 prevents the post from escaping the housing. The housing 180 also includes the usual conductive pathway (not shown) which is open when the post 182 is biased outwardly and is closed by the post when the post is pushed sufficiently into the housing against the bias of the spring.

One or more microswitches 156 may be served to top wall 136 as depicted in FIG. 3 such that when bumper 143 moves upwardly a predetermined distance, the post 182 is pushed by upper wall 150 sufficiently into housing 182 to close the conductive pathway.

Of course, the microswitches 156 may be replaced by other types of electrical sensors. For example, one or more microswitches 156 may be replaced by confronting electrical contacts mounted on top wall 136 of shelf member 134 and upper walls 150, respectively. In such an embodiment it will be apparent that a conductive pathway is established when bumper 143 is displaced toward shelf member 134 sufficiently for the confronting contacts to touch. Alternatively, optical sensors may be employed to service when bumper 143 has moved upwardly toward field member 134 by a predetermined distance. An electrically conductive cable 176 is in electrically conductive relation with microswitches 156. A cable 176 suitable for this purpose includes a pair of conductors 177, represented schematically in FIG. 1, connected in parallel with microswitches 156. The cable 176 may be insulated, as by a braided insulation sleeve shown in FIG. 4. In the embodiment depicted in FIG. 4, the insulation extends to one end cap of shelf member 134 with the conductors 177 extending through an opening (not shown) in the end cap to the microswitches 156. As schematically illustrated in FIG. 1, cable 176 and microswitches 156 are in an electrical circuit with motor 42 such that the motor 42 is activated when one or more of the microswitches is closed as a result of upward movement of bumper 143.

Operation

During normal operation, curtain 30 is raised and lowered by motor-operator unit 40 driving output shaft 26 in response to a conventional switching arrangement (not shown) for activating motor 42 for clockwise or counterclockwise rotation. Normally, when curtain 30 is raised or lowered, brake 64 is released and core 82, brake control shaft 96 and cable 100 are in the positions shown in FIG. 2*a* and discussed hereinabove. When brake cable 100 is in the position shown in FIG. 2*a* arm 168 (FIGS. 4 and 5) is pulled sufficiently to the right to rotate the linkage levers 158 clockwise to the position illustrated in solid lines in FIG. 5.

If an object 178 illustrated schematically in FIG. 1 situated beneath curtain 30 during lowering thereof is engaged by bumper 143, continued lowering of the curtain collapses shelf member 134 on the bumper such that inturned lips 140 of the shelf member 134 move away from the upper walls 150 of the bumper. Upon sufficient movement of shelf member 134 relative to bumper 143, one or more of the microswitches 156 are moved to their closed positions as upper walls 150 urge posts 182 into housings 180.

As schematically illustrated in FIG. 1, closure of one or more of the microswitches 156 operates to stop position of motor 42 which halts further descent of curtain 30. Optionally, motor-operator unit 40 may automatically reverse its direction of position in response to closure of one or more microswitches 156 thereby to raise the curtain 30 away from object 178. Suitable circuitry for accomplishing these objectives is well known to those skilled in the art.

If, however, there is a power failure during closure of curtain 30, such as may occur in the case of an emergency, closure of microswitches 156 will have no effect on blocking closure of curtain 30 as motor 42 will be inoperative. In such event the present invention nevertheless arrests downward movement of curtain 30 when it strikes an object 178. As discussed hereinabove, collapsing shelf member 134 on bumper 143 is a result of engagement of the bumper with an object 178 causes central flange 154 to move toward bottom wall 144 of bumper 143. Such relative movement produces counterclockwise rotation of linkage levers 158 (is viewed in FIGS. 4 and 5) thereby causing arm 168 to translate leftwardly against the bias of spring 198. Leftward translation of arm 168 results in corresponding movement of brake cable 100 which draws laminate 99 of brake controller 58 upwardly as viewed in FIGS. 2*a* and 2*b*. Sufficient counterclockwise rotation of one or more linkage levers 158 causes brake cable 100 to move core 82 upward to the position shown in FIG. 2*b* which, as explained hereinabove, results in engagement of brake 64 which halts further closing of curtain 30. It will be apparent that the recesses 148 accommodate relative movement between shelf member 134 and bumper 143 and that the receivers are sufficiently high that linkage levers are moved to their dashed line positions in FIG. 5 before lower walls 152 of bumper 143 contact inturned lips 140 of shelf member 134.

The spacing between posts 182 of microswitches 158 and the upper walls 150 of bumper 143 is such that the microswitches are closed before the linkage levers 158 are rotated sufficiently to effect engagement of brake 64. Therefore, provided motor-operator unit 40 and microswitches 156 are functioning properly, descent of curtain 30 is halted and optionally reversed by motor 42 before brake 64 is engaged. However, if motor-operator unit 40 and/or microswitches 156 are inoperable, closing of the microswitches 156 will have no effect on descent of the curtain 30. Under such circumstances, continued descent of curtain 30 results in sufficient counterclockwise rotation of the linkage levers 158 to the position illustrated by dashed lines in FIG. 5 whereupon the brake 64 is engaged for arresting descent of the curtain as explained hereinabove.

It will be apparent, therefore, that brake actuator 20 provides curtain 30 with obstruction-responsive sensitivity during normal operation and in the event of a power interruption.

If the object 178 is removed from the path of travel of brake actuator 20, bumper 143 drops away from shelf member 134 to its solid line position in FIG. 3. If only microswitches 156 had been engaged, movement of bumper 143 away from shelf member 134 returns microswitches 156 to their open condition whereupon motor 42 is restored to normal operation. If closure of curtain 30 was effected by linkage levers 158 rotating sufficiently to engage brake 64, upon movement of bumper 143 away from shelf member 134 spring 190 moves arm 168 to the right in FIGS. 4 and 5 thereby returning linkage levers to their solid line positions (FIG. 5). Movement of arm 168 to the right results in corresponding translation of brake cable 100 which urges core 82 to the position shown in FIG. 2A whereupon brake 64 is disengaged and curtain 30 is free to move to its fully closed position as explained hereinabove.

It will be apparent that if during closure of the curtain 30 the curtain is permitted to move downwardly until the bumper 143 strikes the floor 28 or other confronting surface the bumper 143 will activate the brake mechanism in the manner described hereinabove. This is undesirable because it results in unnecessary actuation of linkage levers 158 and arm 168 which, over time, may fail. Accordingly, and as is known in the art, the fire door assembly 22 preferably includes a limit switch which is tripped as the bumper 143 approaches the floor 28. In a manner well known in the art, tripping of the microswitch applies power to solenoid 78 for activating the brake 64 in the manner more fully described above such that movement of the door is halted before the brake actuator 20 is actuated by movement of bumper 143 relative to shelf member 134. In a preferred embodiment activation of the limit switch upon closing of the curtain 30 deactivates the microswitches 156. As suitable circuitry for accomplishing this objective will be readily apparent to those of ordinary skill in the art who have read this description, a further description thereof is deemed unnecessary. In any event, even if bumper 143 strikes the floor 28 with sufficient force to actuate brake actuator 20, such action is merely redundant as the sole effect is actuation of brake 64 if it has not already been activated by the limit switch.

As long as power is applied to motor 42 or, upon restoration of power to motor 42 in the event of a power failure, curtain 30 may be raised and lowered in the manner described hereinabove by activating motor 42 to rotate in the appropriate direction. That is, there is no requirement of resetting the brake actuator 20 each time it is actuated upon striking an object 178 or floor 28. Rather, and as will be apparent from the foregoing description, brake actuator 20, even when operating in its fully mechanical mode i.e., in response to pivoting of linkage levers 158, automatically resets.

Manually Driven Fire Door

Figure 6:
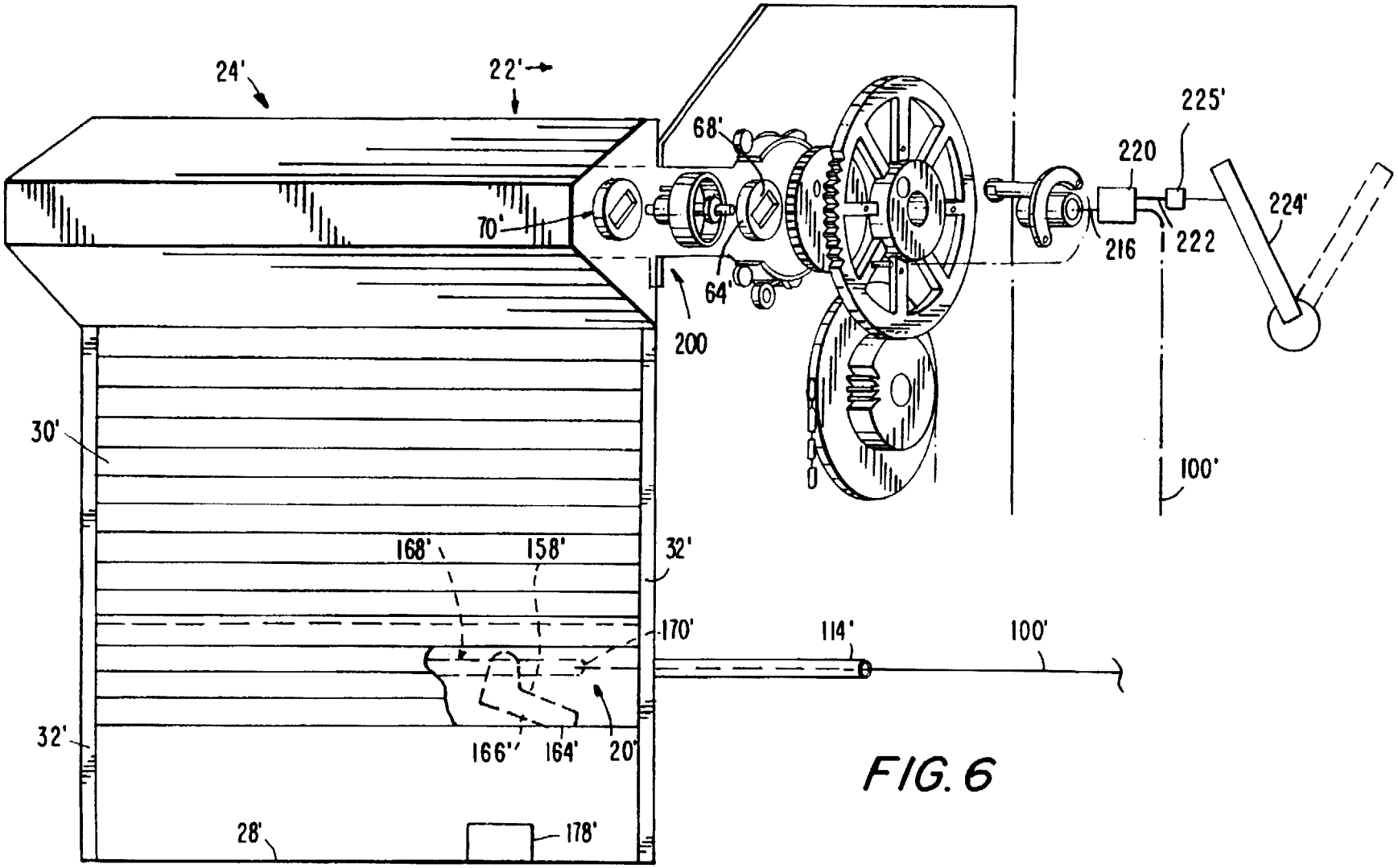
FIG. 6 is a partially exploded perspective view of a second embodiment of the obstruction-responsive brake actuator of the present invention.

The brake actuator 20 of the present invention is also applicable to manually driven safety barriers including, but not limited to, the manually driven fire door assembly 22' illustrated in FIG. 6 and fully described in a copending U.S. Provisional Patent Application titled Drive Mechanism With Automatically Resetting Emergency Closing Device For Fire Door Assembly And The Like.

In the manually driven fire door assembly 22', brake 64' is released for emergency closing of curtain 30' by movement of cable 216 to the left as viewed in FIG. 6. As explained in said copending U.S Provisional Patent Application, cable 216 is released forleftward movement either by melting of fusible link 225', movement of lever 224' in a counterclockwise direction, i.e. to the solid line position in FIG. 6, or by any other suitable mechanism such as by actuation of a solenoid.

To incorporate the brake actuator 20 of the present invention in such a manually driven fire door cable 100' is coupled to cable 216 by a mechanical couple 220 diagrammatically illustrated in FIG. 6. Consequently, actuation of brake actuator 20' by linkage levers 158 in the manner described above results in rightward movement of cable 216 for actuating brake 64'.

It will therefore be apparent that during emergency closing of curtain 30' upon disengagement of brake 64', brake 64' will be reactivated by brake actuator 20' when bumper 143' strikes an object 178'. As with the brake actuator 20 described above in connection with FIGS. 1–5, once the object 178' is removed the brake 64' is again deactivated.

It will be further apparent that inasmuch as fire door assembly 22' is manually driven, there may be no available power source, in which event microswitches 156 depicted in the embodiment of FIGS. 1–5 may be dispensed with in which event brake actuator 20' will only be actuated upon rotation of linkage levers 158' as is more fully described above.

Thus, while there have been shown and described and pointed out fundamental novel features of the invention as applied to preferred embodiments thereof, it will be understood that various omissions and substitutions and chances in the form and details of the devices illustrated, and in their operation, may be made by those skilled in the art without departing from the spirit of the invention. For example, it is expressly intended that all elements and/or method steps which perform substantially the same function in substantially the same way to achieve the same result as the elements specifically disclosed in the specification.

What is claimed is:

1. An obstruction-responsive brake actuator for a fire door safety barrier comprising a rollable fire door curtain having a leading edge which, when the curtain is closing, faces the direction of travel such that an object obstructing closure of the curtain is brought in close proximity to the leading edge, the safety barrier further including a brake operatively engageable with the curtain for preventing closure thereof, the brake being biased against operative engagement with the curtain, the curtain being biased to close when it is out of operative engagement with the brake, said obstruction-responsive brake actuator comprising:

a support;

a bumper carried by said support and movable relative thereto in a direction parallel to the direction of travel of said curtain between an operative position and an inoperative position, said bumper having a lower surface which contacts said object obstructing closure of the curtain; and a load-carrying linkage carried by said support and including actuating means connected to the brake and moveable into and out of an actuating position relative to said support so that when a force is applied to said bumper sufficient for movement of said bumper to said operative position, the force is transmitted through said linkage to the brake for causing operative engagement of the brake with the curtain, thereby preventing further closure of the curtain.

2. The brake actuator of claim 1, wherein said load carrying linkage comprises a member pivotally connected to said support and having a first end and a second end, said first end being disposed proximate said lower surface of said bumper and said second end comprising said actuating means.

3. The brake actuator of claim 2, wherein said actuating means comprises a cable connected at one end to the brake and at another end to said second end of said support so that movement of said first end of said support by said lower surface of said bumper moves said second end and said cable for causing engagement of the brake with the curtain.

4. The brake actuator of claim 3, further including a motor connected to the curtain for controlling movement of the curtain, said actuator further comprising a microswitch connected to said support and engageable by said bumper for blocking power to the motor when said bumper is in its operative position.

5. The brake actuator of claim 1, further including a motor connected to the curtain for controlling movement of the curtain, said actuator further comprising a microswitch connected to said support and engageable by said bumper for blocking power to the motor when said bumper is in its operative position.

6. The brake actuator of claim 5, wherein said microswitch comprises a post having an end disposed proximate said bumper so that when said bumper contacts said object obstructing closure of the curtain, said bumper engages said post for activating said microswitch.

7. The brake actuator of claim 6, wherein the distance between the lower surface and said post end of said microswitch is smaller than the distance between the lower surface and said first end of said member.

8. The brake actuator of claim 7, wherein said load carrying linkage comprises a plurality of members, each pivotally connected to said support and disposed in a common plane with respect to each other.

9. The brake actuator of claim 1, wherein when said force is no longer applied to said bumper for movement of said bumper to said operative position, the brake is released from the curtain to permit closure of the curtain.

10. The brake actuator of claim 8, wherein when said force is no longer applied to said bumper for movement of said bumper to said operative position, the brake is released from the curtain to permit closure of the curtain.

* * * * *